US006101936A

United States Patent [19]

Claassen

[11] Patent Number: 6,101,936

[45] Date of Patent: Aug. 15, 2000

[54] SQUEEGEE WITH A FIXED SUPPORTING PART

[75] Inventor: Wilhelmus J.A.L.M. Claassen, Boxmeer, Netherlands

[73] Assignee: Stork Brabant B.V., Boxmeer, Netherlands

[21] Appl. No.: 09/022,853

[22] Filed: Feb. 12, 1998

[30] Foreign Application Priority Data

Feb. 18, 1997 [NL] Netherlands ..... 1005308

[51] Int. Cl.[7] ..... B41L 13/06

[52] U.S. Cl. ..... 101/119

[58] Field of Search ..... 101/119, 116, 101/120, 424, 425

[56] References Cited

U.S. PATENT DOCUMENTS

| | | | |
|---|---|---|---|
| 1,596,032 | 8/1926 | Thatcher | 101/119 |
| 3,089,175 | 5/1963 | Hinder | 101/120 |
| 3,834,307 | 9/1974 | Zimmer | 101/119 |
| 3,930,445 | 1/1976 | Jaffa | 101/120 |
| 3,952,650 | 4/1976 | Lotte | 101/120 |
| 4,138,943 | 2/1979 | Mitter | 101/120 |
| 4,329,936 | 5/1982 | Heist et al. | 101/120 |
| 5,572,928 | 11/1996 | Negishi | 101/119 |
| 5,644,986 | 7/1997 | Gydesen | 101/425 |
| 5,660,632 | 8/1997 | Volpe, Jr. et al. | 101/120 |
| 5,771,800 | 6/1998 | Inamine et al. | 101/119 |

FOREIGN PATENT DOCUMENTS

| | | | |
|---|---|---|---|
| 0011314 | 5/1980 | European Pat. Off. . | |
| 0285217 | 10/1988 | European Pat. Off. . | |
| 0349506 | 1/1990 | European Pat. Off. . | |
| 7906305 | 2/1981 | Netherlands | 101/119 |

*Primary Examiner*—John S. Hilten
*Assistant Examiner*—Amanda B. Sandusky
*Attorney, Agent, or Firm*—Ladas & Parry

[57] ABSTRACT

A squeegee for a screen-printing machine, in particular a rotary screen-printing machine, comprises a supporting part, which can in principle be attached permanently to the frame of a screen-printing machine, as well as a removable part, which is detachably connected to the supporting part. The supporting part is designed as a rigid bar which extends in the longitudinal direction of the squeegee. The removable part is displaceable in the longitudinal direction with respect to the supporting part. The removable part forms the active squeegee part. The supporting part may be of rigid design, while the removable part may be of lightweight design. The removable part comprises in particular those components which regularly have to be removed from the screen-printing machine.

9 Claims, 3 Drawing Sheets

SQUEEGEE WITH A FIXED SUPPORTING PART

The invention relates to a squeegee for a screen-printing machine, in particular a rotary screen-printing machine.

Squeegee systems feed and distribute printing paste inside stencils of rotary screen-printing machines. The printing paste is applied, via openings in the stencil, to the substrate to be printed on by means of the squeegee.

The squeegee systems used hitherto were composed of plates and tubes of stainless steel, aluminium or fibre-reinforced plastic. The separate components, and also the assembly formed by these components, have to satisfy a number of mechanical and chemical properties. One of these properties is the (flexural) stiffness. The squeegee has to retain its shape under the loads occurring during use as a result of the squeegee force, the frictional force and the intrinsic weight of the squeegee. With a view to the quality of the printing, it is necessary to avoid bending of the squeegee.

An important factor in this connection is the weight of the squeegee. Firstly, the bending of the squeegee under the influence of its own weight should be as low as possible, in order to achieve uniform contact between the squeegee and the stencil of the screen-printing machine. Uniform contact of this nature provides uniform quality of the printing.

Furthermore, the weight of the squeegee is important to the operators of the printing machine. This is because squeegees have to be replaced regularly, for example for the following reasons:

a) cleaning the squeegee outside the machine for the purpose of removing adhering paste, for example when changing the colour of paint to be printed. The roller of a roller squeegee or the blade of a blade squeegee and the paint-distribution pipe, in particular, become soiled by paste;

b) matching the squeegee length to the length of the stencil, for example when changing the printing width in a rotary screen-printing machine. In the case of a roller squeegee, the roller length, and in the case of a blade squeegee, the blade length have to be adapted in this process. Furthermore, the length of the paint-distribution pipe has to be adapted to the printing width;

c) different choice of squeegee-roller diameter or type of squeegee blade, for example for a squeegee action which is matched better to the paste and the stencil;

d) replacement of the squeegee in the event of damage to the squeegee roller or the squeegee blade.

However, a squeegee is difficult to handle, owing to the weight and the length of the squeegee, which length may be more than 3 meters, and the small diameter of the stencil in which the squeegee is held. When heavy squeegees are being replaced, there is a considerable risk of damage to the squeegee and/or the stencil.

As explained briefly above, a high flexural stiffness of the squeegee is desirable, in order to limit the bending under the influence of its own weight. Also, the bending resulting from other forces acting on the squeegee during use should be as low as possible.

The object of the invention is to eliminate the drawbacks of the known squeegee systems.

This object is achieved according to the invention by means of a squeegee which comprises a supporting part, which can in principle be attached permanently to the frame of the screen-printing machine, as well as a removable part, which is detachably connected to the supporting part.

This design allows the supporting part, which is attached permanently to the frame, to be rigid and the removable part to be lightweight, thus providing a squeegee which satisfies the requirements set, in particular relating to flexural stiffness, and does not have the drawbacks of the known squeegee structures. The removable squeegee part may comprise only those components of the squeegee which are usually the reason in practice for having to remove the squeegee out of the screen-printing machine, namely the squeegee roller or the squeegee blade and the paint-distribution pipe. This results in the advantage that only the weight of the squeegee roller or the squeegee blade and the paint-distribution pipe are decisive for the weight of the detachable, active part to be handled. The weight of the supporting part, which is to be made relatively heavy and rigid, does not impair handling of the removable part.

Preferred embodiments of a squeegee according to the invention are defined in the dependent claims 2 to 13.

The invention likewise relates to a screen-printing machine provided with at least one squeegee according to the invention.

The invention will be explained in more detail in the following text with reference to the drawing, in which.

Figure 2:
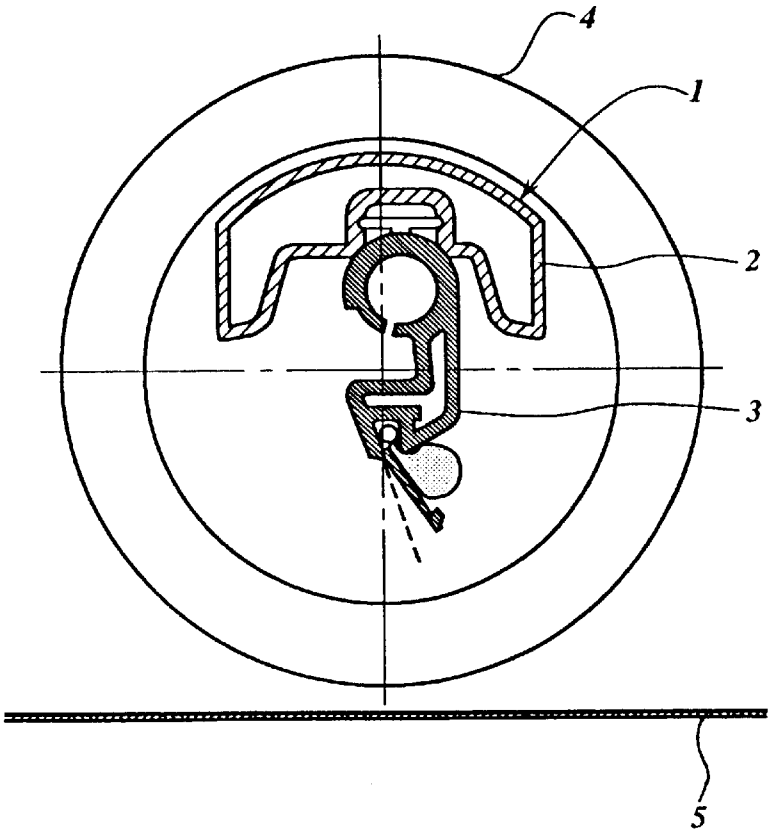
FIGS. 1 and 2 show diagrammatic side views of a first embodiment of a squeegee according to the invention, in the form of a blade squeegee, in the active position and in the free position.
Figure 1:
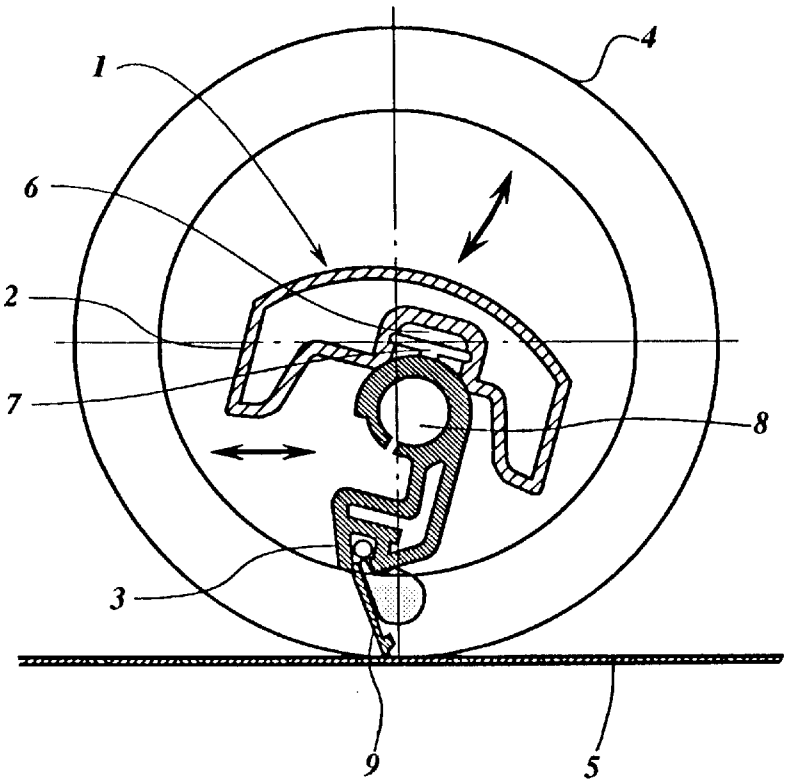

FIGS. 1 and 2 diagrammatically illustrate a first embodiment of a squeegee 1 according to the invention in the operating position (FIG. 1) and the free position (FIG. 2). The squeegee comprises a supporting part 2, which can in principle be attached permanently to the frame of the screen-printing machine (not shown), and a removable part 3, which can be connected detachably to the supporting part 2. The supporting part 2 can be fixed to the frame of the screen-printing machine, but it is also possible for the position of the supporting part 2 to be adjustable with respect to the frame.

The squeegee 1 is accommodated in a stencil 4 which is indicated diagrammatically. The substrate to be printed on is denoted by the reference numeral 5.

The supporting part 2 is designed as a sleeve-like bar which extends in the longitudinal direction of the squeegee 1 and has a flexural stiffness which is such that it is deformed so little under the influence of its own weight and the loads arising during use that the substrate 5 can be printed uniformly. The removable part 3 is displaceable in the longitudinal direction of the squeegee with respect to the supporting part 2. In the embodiment illustrated, the supporting part 2 is provided with a recess 6, while the removable part is provided with a T-shaped strip 7 which fits into this recess 6.

In FIGS. 1 and 2, the squeegee is designed as a blade squeegee. Printing paste, which is supplied via a channel 8 arranged in the removable part and passes into the stencil via openings in the channel wall, is pressed through openings in the stencil 4 with the aid of a squeegee blade 9, with the result that the printing paste is applied to the substrate 5 in a pattern which is defined by the openings in the stencil 4.

The supporting part 2 of the squeegee is designed to be supported at least at one end by the frame of the screen-printing machine. The supporting part 2 may advantageously also be supported at the other end by the frame of the screen-printing machine. In order to be able to remove the stencil from the screen-printing machine, one of the two supports will generally be temporarily removable.

The supporting part of the squeegee may be attached to the frame of the screen-printing machine in such a manner that the squeegee is vertically adjustable, in order to move the squeegee from the operating position illustrated in FIG. 1 to the free position illustrated in FIG. 2, and vice versa.

Figure 4:
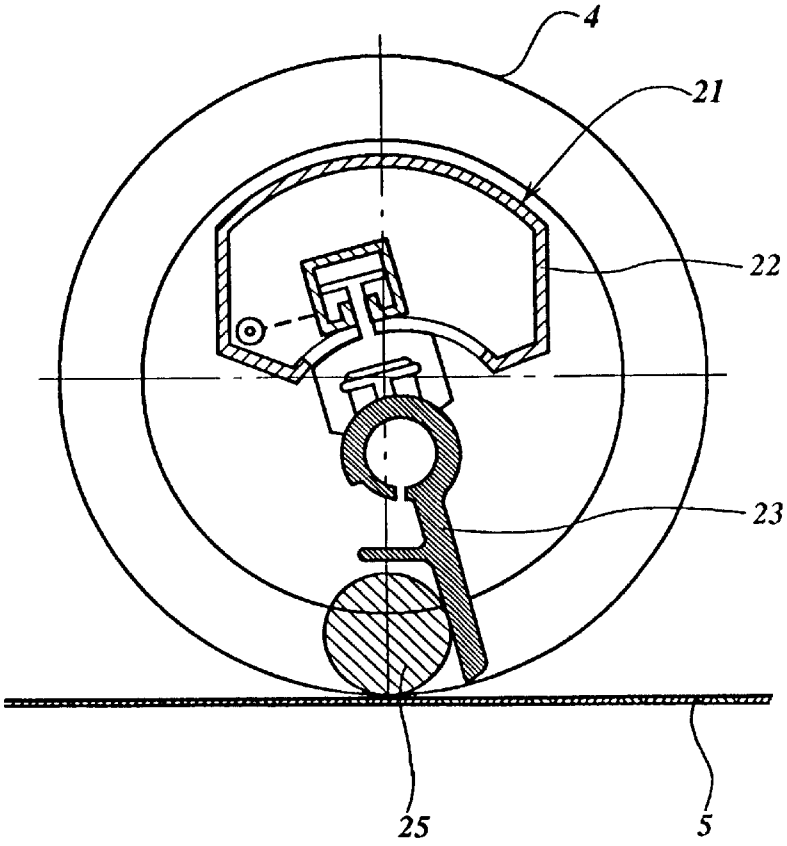
FIGS. 3 and 4 show diagrammatic side views of a squeegee according to the invention in the form of a roller squeegee with a small roller and a large roller, respectively.
Figure 3:
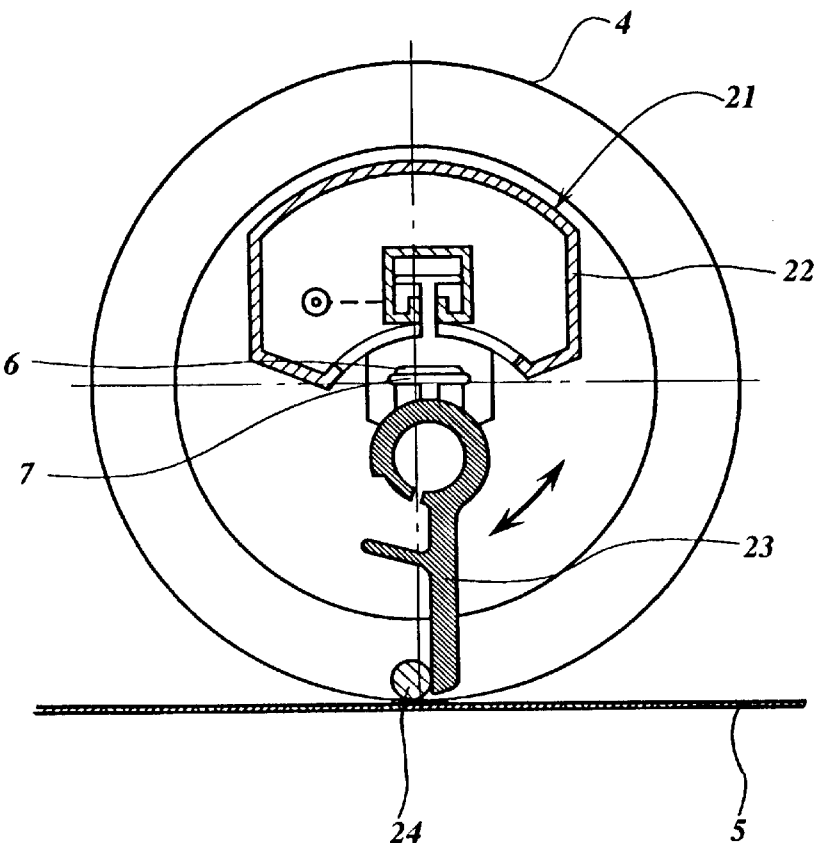

FIGS. 3 and 4 illustrate embodiments of a squeegee 21 according to the invention in the form of a roller squeegee. The only difference between the two embodiments lies in the diameter of the rollers 24 and 25. The supporting part 22 is heavier and has a greater flexural stiffness than the supporting part 2 of the embodiments described previously. The removable part 23 is also designed differently. The connection between the supporting part 22 and the removable part 23 is in this case too formed by a T-shaped strip 7 which is connected to the removable part 23 and fits into a recess 6 in the supporting part 22.

Figure 5:
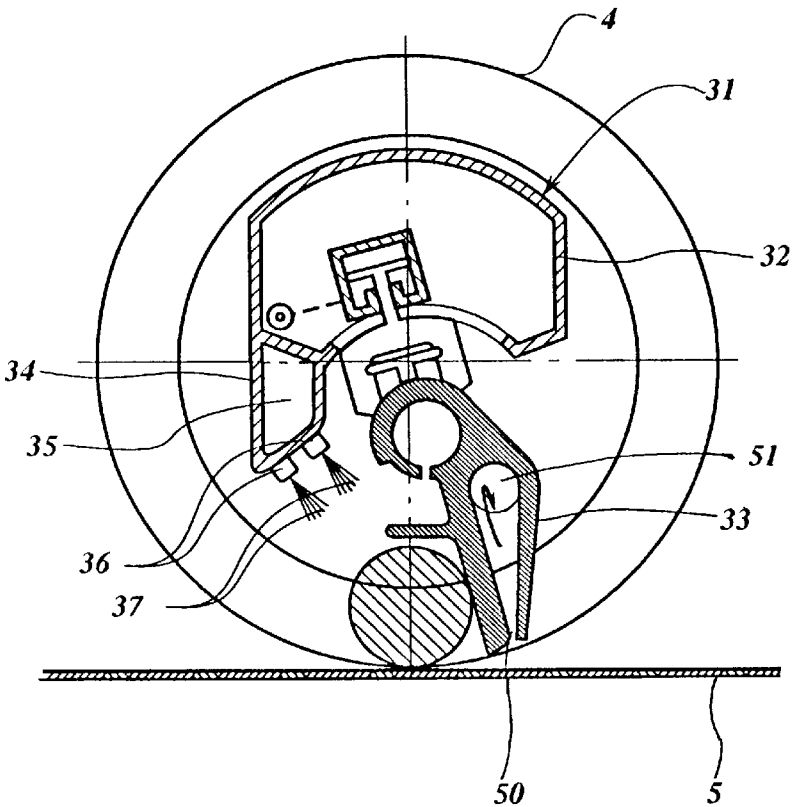
FIG. 5 shows a diagrammatic side view of a squeegee according to the invention which is provided with a first type of washing device.

FIG. 5 illustrates a squeegee 31 according to the invention which in principle corresponds to the embodiment shown in FIG. 4, except for the fact that the squeegee 31 is provided with means for cleaning the squeegee. These means comprise an extra part 34 on the supporting part 32, which extra part forms a channel 35 and being provided with sprayers 36 for spraying cleaning liquid 37, which is supplied via the channel 35, onto the squeegee, in particular the removable part 33. Furthermore, the part 34 may be provided with sprayers for cleaning the stencil 4.

Figure 6:
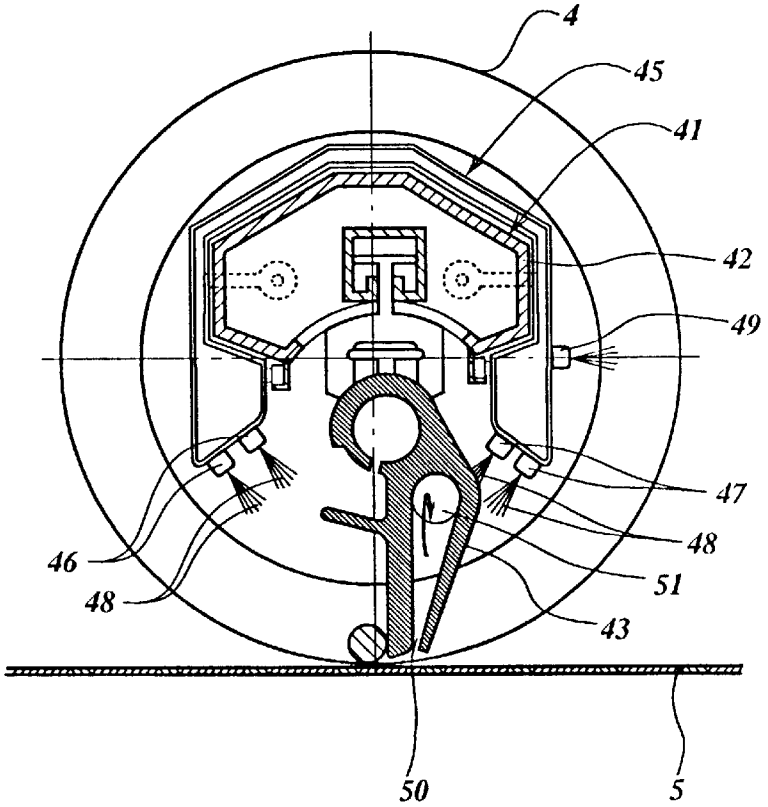
FIG. 6 shows a diagrammatic side view of a squeegee according to the invention provided with a second type of washing device.

Means for cleaning the squeegee may also be designed differently, as indicated in FIG. 6 with a squeegee 41. In the embodiment illustrated in FIG. 6, a type of carriage 45 is displaced in the longitudinal direction along the specially shaped supporting part 42 of the squeegee 41. The carriage 45 is provided with sprayers 46 and 47, by means of which cleaning liquid 48 can be sprayed onto that part of the squeegee 41 which is to be cleaned (in this case the removable part 43). The cleaning liquid 48 is supplied via the carriage 45.

The carriage 45 may furthermore also be provided with sprayers 49 by means of which the stencil 4 can be cleaned.

In the embodiments shown in FIGS. 5 and 6, the cleaning agent can be discharged via the removable part 33 or 43, respectively, of the squeegee 31 or 41, respectively, which for this purpose is provided with suction openings 50 and a discharge channel 51.

By designing a squeegee in accordance with the invention, it is possible to achieve the following advantages:

1) when cleaning or replacing the squeegee, the supporting part of the squeegee can remain on the machine, while only the removable part, which may be of lightweight design, is detached;
2) the structure can be made very rigid, with the result that there is less bending in a direction perpendicular to the direction of advance of the substrate and there is less risk of the squeegee vibrating in the direction of movement of the substrate;
3) attaching and dismantling the stencil and the removable squeegee part are facilitated by the fact that the supporting part of the squeegee can serve as a guide for the stencil and for the removable squeegee part, with the result that shorter change-over times are achieved and there is less risk of damage to the stencil;
4) the supporting part of the squeegee can serve as a stationary support for means for cleaning the squeegee and the stencil on the machine (for example by spraying them with cleaning liquid), with the result that these means can be of relatively simple design and do not increase the weight of the removable part;
5) the supporting part enables parts of the squeegee to be exchanged easily, including the paste-distribution tube, the squeegee blade and/or the roller-squeegee holder;
6) in certain embodiments of a screen-printing machine, the stencil mounts can be attached to the supporting squeegee parts, with the result that bars between the stencils can be dispensed with, so that there is a better view of the substrate or the screen-printing machine can be made shorter.

The supporting part of the squeegee can be designed in various ways. The supporting part of the squeegee can be of lightweight design (for example by using carbon fibres). The advantage of this is that the supporting part can be removed from the screen-printing machine easily, which may be necessary for cleaning the supporting part or for maintenance work. However, the supporting part may also be heavy, so that it cannot be removed from the screen-printing machine, or can be removed only with difficulty. This heavy design has the advantage that the supporting part can be made very rigid, since the weight is of subordinate importance.

Furthermore, it is conceivable for the supporting part to be designed in such a manner that the stencil can also be supported by this supporting part. The advantage referred to above under 6) applies in particular to a design of this nature.

In general, it will be attempted to make the removable part of the squeegee as lightweight as possible. To this end, the paste-supply channel can be arranged on the supporting part of the squeegee. In that case, the paste-supply channel can be cleaned on the screen-printing machine by flushing cleaning liquid through it. In embodiments in which the squeegee is provided with cleaning means (FIGS. 5 and 6), in order to reduce the weight of the supporting part further, the discharge members can be arranged on the supporting part or optionally on the carriage 45 (FIG. 6).

The supporting part of the squeegee according to the invention may furthermore be provided with a printing-paste level sensor (not shown), which can be used to measure the level of the printing paste in the stencil.

In the case of a roller squeegee (FIGS. 3–6), the supporting part may be provided with a cartridge with squeegee rollers (for example three rollers) of different diameters (not shown), which can be selectively placed in the active squeegee position by changing them over on the printing machine.

The removable part of the squeegee can be made vertically adjustable by means of an adjustable connection (not shown) to the supporting part.

The supporting part of the squeegee may itself also be mounted in a vertically adjustable manner on the frame of the screen-printing machine.

However, it is also possible for the supporting part to have a fixed height, by supporting it fixedly at one end by the frame of the screen-printing machine. At the other end, the supporting part can then be supported in a non-fixed manner, for example by means of a swing-out support (not shown), which may advantageously be provided with positioning members for positioning the supporting part.

What is claimed is:

1. A squeegee for a rotary screen-printing machine comprising a frame, the squeegee comprising a supporting part which is suitable for permanent attachment to the frame of a rotary screen-printing machine, and a removable part, which is detachably connected to the supporting part, the removable part forming the active squeegee part and being displaceable in the longitudinal direction of the squeegee with respect to the supporting part, the supporting part serving as a guide for the removable part during displacement in the longitudinal direction wherein the removable part comprises printing paste supply means.

2. The squeegee of claim 1, wherein the supporting part is provided with a recess and the removable part is provided with a T-shaped strip which fits into the recess, the T-shaped strip being displaceable in the recess in the longitudinal direction of the squeegee.

3. The squeegee of claim 1, wherein the supporting part is designed as a rigid bar which extends in the longitudinal direction of the squeegee.

4. Squeegee according to claim 1, wherein the supporting part is provided with means for cleaning the squeegee.

5. Squeegee according to claim 4, wherein the means for cleaning the squeegee comprises an extra part on the supporting part, which extra part forms a channel.

6. Squeegee according to claim 4, wherein the means for cleaning the squeegee comprises a carriage which is displaceable in the longitudinal direction along the supporting part.

7. Squeegee according to claim 6, wherein the means for cleaning the squeegee further comprise sprayers for spraying cleaning liquid onto the squeegee.

8. A rotary screen-printing machine comprising a frame and provided with at least one squeegee comprising a supporting part attached to the frame of the rotary screen-printing machine, and a removable part which is detachably connected to the supporting part, the removable part forming the active squeegee part and being displaceable in the longitudinal direction as a guide for the removable part during displacement in the longitudinal direction wherein the removable part comprises printing paste supply means.

9. The rotary screen-printing machine of claim 8, wherein the supporting part of the squeegee is adjustable in a vertical direction.

* * * * *

UNITED STATES PATENT AND TRADEMARK OFFICE

CERTIFICATE OF CORRECTION

PATENT NO: 6,101,936

DATED: August 15, 2000

INVENTOR(S): CLAASSEN

It is certified that error appears in the above-identified patent and that said Letters Patent is hereby corrected as shown below:

| Where: | correction: |
|---|---|
| Column 6, line 14, (Claim 8, line 7) | after "longitudinal direction", insert -- of the squeegee with respect to the supporting part, the supporting part serving --. |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*